US009395088B2

(12) United States Patent
Wiggins et al.

(10) Patent No.: US 9,395,088 B2
(45) Date of Patent: Jul. 19, 2016

(54) OVEN APPLIANCE AND A METHOD FOR MANUFACTURING A COOKING CHAMBER OF AN OVEN APPLIANCE

(71) Applicant: General Electric Company, Schenectady, NY (US)

(72) Inventors: William Byron Wiggins, Marietta, GA (US); Bryan Keith Lawler, Ringgold, GA (US); Deandre Laron Strong, Rossville, GA (US); Michael David Gallant, Ooltewah, TN (US)

(73) Assignee: General Electric Company, Schenectady, NY (US)

( * ) Notice: Subject to any disclaimer, the term of this patent is extended or adjusted under 35 U.S.C. 154(b) by 372 days.

(21) Appl. No.: 13/967,444

(22) Filed: Aug. 15, 2013

(65) Prior Publication Data

US 2015/0047623 A1 Feb. 19, 2015

(51) Int. Cl.
*F24C 15/00* (2006.01)
*F24C 15/08* (2006.01)

(52) U.S. Cl.
CPC ..... *F24C 15/005* (2013.01); *F24C 15/008* (2013.01); *F24C 15/08* (2013.01); *Y10T 29/49885* (2015.01); *Y10T 29/49893* (2015.01); *Y10T 29/49947* (2015.01)

(58) Field of Classification Search
CPC ..... F24C 15/005; F24C 15/08
USPC ..... 126/37 R
See application file for complete search history.

(56) References Cited

U.S. PATENT DOCUMENTS 119,680 A * 10/1871 Willson ..... F24C 15/08 126/275 R
249,843 A * 11/1881 Klein et al. ..... F24C 15/08 126/275 R
337,127 A * 3/1886 Boynton ..... F24C 15/08 126/1 R
401,723 A * 4/1889 Stubbers ..... F24C 15/08 126/275 R
589,972 A * 9/1897 Blomskog ..... F24C 15/08 126/275 R
639,099 A * 12/1899 Schoregge ..... F24C 15/08 126/275 R
639,646 A * 12/1899 Adler ..... F24C 15/08 126/275 R
847,482 A * 3/1907 Knauss ..... F24C 15/08 126/19 R
858,790 A * 7/1907 Breen ..... F24C 15/08 126/19 R
879,051 A * 2/1908 Jeavons ..... F24C 15/08 126/275 R
889,236 A * 6/1908 Janes ..... F24C 15/007 126/19 M
964,855 A * 7/1910 Flannery ..... F24C 15/08 126/275 R
964,914 A * 7/1910 Huenfeld ..... F24C 15/08 126/275 R (Continued)

*Primary Examiner* — Kenneth Rinehart
*Assistant Examiner* — Logan Jones
(74) *Attorney, Agent, or Firm* — Dority & Manning, P.A.

(57) ABSTRACT

An oven appliance is provided. The oven appliance includes a top panel, a bottom panel, a back panel and a pair of side panels. The top panel, the bottom panel, the back panel and the pair of side panels are mounted to one another with a plurality of fasteners. The top panel, the bottom panel, the back panel and the pair of side panels define a cooking chamber for receiving food items for cooking.

11 Claims, 5 Drawing Sheets

(56) References Cited

U.S. PATENT DOCUMENTS 965,559 A * 7/1910 Blomskog ..... F24C 15/08 126/19 R
1,016,565 A * 2/1912 Huenefeld ..... F24C 15/08 126/275 R
1,037,770 A * 9/1912 Huenefeld ..... F24C 15/08 126/275 R
1,039,290 A * 9/1912 Huenefeld ..... F24C 15/08 126/275 R
1,453,710 A * 5/1923 Hoffman ..... F24C 15/08 126/1 R
1,507,551 A * 9/1924 Widman ..... B62D 29/02 296/135
1,546,247 A * 7/1925 Moecker, Jr. ..... F24C 15/08 126/39 B
1,554,395 A * 9/1925 Young ..... F24C 15/007 109/84
1,564,034 A * 12/1925 Tinnerman ..... F24C 15/08 126/190
1,578,937 A * 3/1926 Tinnerman ..... F24C 15/08 126/39 B
1,663,348 A * 3/1928 Moecker, Jr. ..... F24C 15/08 126/39 B
1,728,108 A * 9/1929 Cuffe ..... F24C 7/00 126/275 R
1,991,519 A * 2/1935 Pickup ..... F24C 15/08 126/39 B
2,019,045 A * 10/1935 Chafee ..... F24C 15/08 126/37 R
2,059,666 A * 11/1936 Thompson ..... A47J 37/041 99/345
2,073,165 A * 3/1937 Moore ..... F24C 15/08 126/39 B
2,135,432 A * 11/1938 Brodton ..... F28B 1/06 165/138
2,161,537 A * 6/1939 Stockstrom ..... F24C 15/08 126/39 B
2,217,059 A * 10/1940 Klute ..... F24C 15/08 126/1 R
2,258,489 A * 10/1941 Grindle ..... F24C 15/08 126/37 R
2,325,772 A * 8/1943 Hennessy ..... F24C 11/00 126/39 A
2,335,279 A * 11/1943 Hobson ..... F24C 15/08 126/39 B
2,391,436 A * 12/1945 Miskella ..... F26B 3/30 52/792.11
2,571,622 A * 10/1951 Schmidt ..... A47B 47/03 16/389
2,622,584 A * 12/1952 Reeves ..... F24C 15/08 126/39 B
2,701,174 A * 2/1955 Franks ..... A47B 88/0014 220/4.28
2,705,947 A * 4/1955 Pearce ..... F24C 15/022 126/1 R
2,747,269 A * 5/1956 Atchison ..... F25D 23/06 228/137
2,769,440 A * 11/1956 Pearce ..... F24C 15/08 126/37 R
2,798,785 A * 7/1957 Chesser ..... F24C 15/08 312/265.1
3,033,188 A * 5/1962 Cline ..... F24C 3/027 126/19 R
3,120,224 A * 2/1964 Divelbiss ..... F24C 15/007 126/39 M
3,145,289 A * 8/1964 Swetlitz ..... F24C 3/027 126/19 M
3,291,113 A * 12/1966 Scott ..... B32B 15/01 126/19 R
3,294,276 A * 12/1966 Kemp ..... A47B 47/03 126/114
3,402,281 A * 9/1968 Vonderhaar ..... F24C 7/00 126/21 R
3,425,405 A * 2/1969 Dills ..... F24C 15/08 126/19 R
3,439,587 A * 4/1969 Sternau ..... B65B 7/2885 493/52
3,731,039 A * 5/1973 Beech ..... F24C 15/34 219/395
3,749,465 A * 7/1973 Newcomer ..... A47B 47/00 312/245
3,783,853 A * 1/1974 Dills ..... F24C 15/005 126/19 R
3,821,850 A * 7/1974 Kowalyk ..... B67B 7/38 30/410
4,092,973 A * 6/1978 Bernazzani ..... F24C 1/16 126/37 A
4,229,921 A * 10/1980 Schell ..... E06B 5/006 126/190
4,232,920 A * 11/1980 Bukaitz ..... A47B 47/03 312/107
4,245,615 A * 1/1981 Moss ..... F24C 15/08 126/19 R
4,296,982 A * 10/1981 Kullander ..... A47B 47/03 211/135
4,455,319 A * 6/1984 Clark ..... H05B 3/30 126/19 R
4,515,143 A * 5/1985 Jabas ..... A21B 1/22 126/21 A
4,629,865 A * 12/1986 Freedman ..... F24C 15/22 219/392
4,694,628 A * 9/1987 Vondergoltz ..... E04D 3/363 52/520
4,886,042 A * 12/1989 Bessler ..... F24C 15/08 126/21 R
5,102,210 A * 4/1992 Beals ..... A47B 55/00 312/330.1
5,921,229 A * 7/1999 Blake ..... F24C 3/14 126/275 R
5,951,131 A * 9/1999 Stefan ..... A47B 47/02 312/257.1
6,008,478 A * 12/1999 Crone ..... F24C 7/06 219/402
6,209,976 B1 * 4/2001 Shear ..... A47B 47/02 312/257.1
6,359,262 B1 * 3/2002 Robertson ..... F24C 7/06 219/402
6,361,181 B1 * 3/2002 Bales ..... H05B 6/6444 126/198
6,831,255 B1 * 12/2004 Levi ..... F24C 7/06 126/21 A
7,014,281 B2 * 3/2006 Wuestefeld ..... A47L 15/4265 126/194
7,497,531 B2 * 3/2009 Gross ..... A47F 9/00 126/25 R
7,789,081 B2 * 9/2010 Raby ..... F24C 15/08 126/273 R
7,810,486 B2 * 10/2010 Bruno ..... A47J 37/0704 126/25 R
7,984,596 B1 * 7/2011 Simpson ..... E04D 3/364 52/478
2004/0264168 A1 * 12/2004 Gotz ..... F24C 15/008 362/92
2007/0272682 A1 * 11/2007 Chin ..... H05B 6/6402 219/725
2008/0122327 A1 * 5/2008 Wu ..... A47B 47/025 312/257.1
2010/0145483 A1 * 6/2010 McGonagle ..... F24C 7/082 700/83
2012/0167865 A1 * 7/2012 Winkelmann ..... F24C 15/08 126/19 R
2013/0014741 A1 * 1/2013 Palla ..... A47J 37/0694 126/19 R
2014/0014085 A1 * 1/2014 Weber ..... F24C 15/005 126/19 R
2014/0283814 A1 * 9/2014 Armstrong ..... F24C 15/16 126/339
2015/0059730 A1 * 3/2015 Marcovicz ..... F24C 15/005 126/273 R
2015/0201465 A1 * 7/2015 Adelmann ..... H05B 3/74 219/461.1

* cited by examiner

OVEN APPLIANCE AND A METHOD FOR MANUFACTURING A COOKING CHAMBER OF AN OVEN APPLIANCE

FIELD OF THE INVENTION

The present subject matter relates generally to oven appliances and methods for manufacturing cooking chambers for oven appliances.

BACKGROUND OF THE INVENTION

Oven appliances generally include a cabinet that defines a cooking chamber for receiving food items for cooking. In certain oven appliances, the cabinet includes a top panel, a bottom panel and an additional panel that are mounted to each other to from the cooking chamber. In such oven appliances, the additional panel is bent into a c-shape to form sidewalls and a back wall of the cooking chamber.

Coatings, such as an enamel coating, can be applied to panels that form the cooking chamber. To avoid damaging the enamel coating, the additional panel is preferably bent into shape and mounted to the top and bottom panels prior to applying the enamel coating to such panels. However, applying enamel coating to the assembled panels can be difficult. For example, applying enamel evenly can be difficult when the panels are assembled. Further, the top panel generally does not require enamel coating. However, avoiding application of enamel coating to the top panel when the panels are assembled can be difficult.

Such panel assemblies also have additional drawbacks. For example, utilizing such panel assemblies across multiple oven appliance designs can be difficult, and such panel assemblies often require cover plates to hide unutilized features. Such cover plates can be cosmetically unappealing. The assembled panels can also be difficult to handle due to their bulk, and the handling difficulty can increase manufacturing time and/or cost. In addition, bending the additional panel to form the sidewalls and the back wall of the cooking chamber can cause the cooking chamber to have rounded corners, and cooking chambers with rounded corners can appear smaller to consumers relative to cooking chambers with square corners. Further, when the additional panel is mounted to the bottom panel, liquid can wick upwardly between the additional panel and the bottom panel and escape the cooking chamber during operating of the oven appliance, and the liquid can negatively affect operation of the oven appliance.

Accordingly, an oven appliance with features for addressing the drawbacks discussed above would be useful. In particular, an oven appliance with features for permitting application of coatings to panels of the oven appliance prior to assembling the panels would be useful.

BRIEF DESCRIPTION OF THE INVENTION

The present subject matter provides an oven appliance. The oven appliance includes a top panel, a bottom panel, a back panel and a pair of side panels. The top panel, the bottom panel, the back panel and the pair of side panels are mounted to one another with a plurality of fasteners. The top panel, the bottom panel, the back panel and the pair of side panels define a cooking chamber for receiving food items for cooking. Additional aspects and advantages of the invention will be set forth in part in the following description, or may be apparent from the description, or may be learned through practice of the invention.

In a first exemplary embodiment, an oven appliance is provided. The oven appliance defines a vertical direction, a lateral direction and a transverse direction. The vertical, lateral and transverse directions are mutually perpendicular. The oven appliance includes a top panel and a bottom panel. The bottom panel is spaced apart from the top panel along the vertical direction. A pair of side panels is spaced apart from each other along the lateral direction. The pair of side panels extends between the top and bottom panels along the vertical direction. Each side panel of the pair of side panels defines an outer surface and has a return flange. The return flange is spaced apart from the outer surface along the lateral direction. A back panel extends between the top and bottom panels along the vertical direction. The oven appliance also includes a plurality of fasteners. Each fastener of the plurality of fasteners extends through the top panel or the bottom panel and a respective return flange of the pair of side panels in order to mount the pair of side panels to the top and bottom panels.

In a second exemplary embodiment, a method of manufacturing a cooking chamber of an oven appliance is provided. The method includes providing a top panel, a bottom panel, a back panel and a pair of side panels, applying an enamel coating onto a respective outer surface of the bottom panel, the back panel and the pair of side panels, applying an aluminum coating onto an outer surface of the top panel, and mounting the back panel and the pair of side panels to the top panel and the bottom panel with a plurality of fasteners after the steps of applying the enamel coating and applying the aluminum coating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
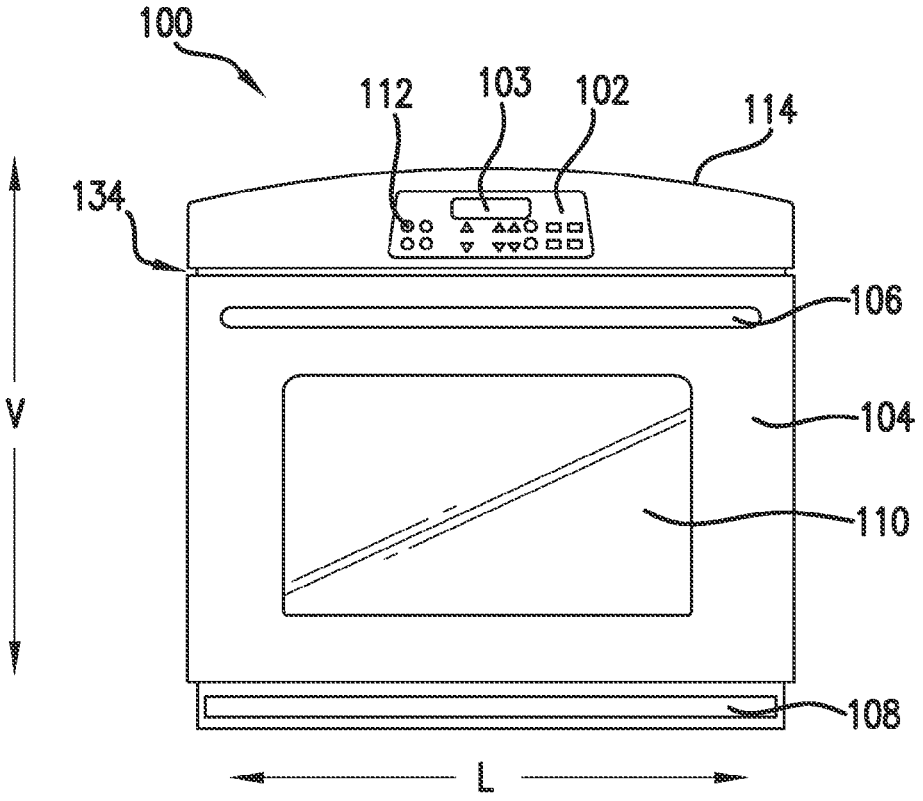
FIG. 1 provides a front, elevation view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
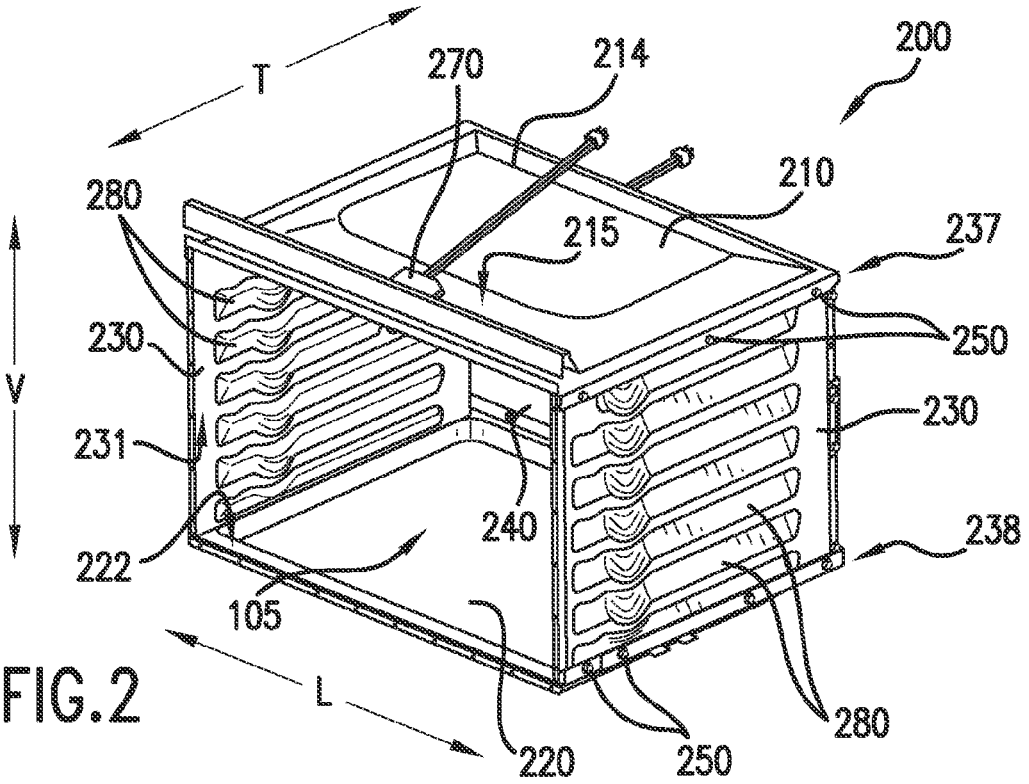
FIG. 2 provides a perspective view of an exemplary panel assembly of the exemplary oven appliance of FIG. 1.

FIG. 1 provides a front, elevation view of an oven appliance 100 according to an exemplary embodiment of the present subject matter. Oven appliance 100 includes a door 104 with a handle 106 that provides for opening and closing access to a cooking chamber 105 (FIG. 2). A user of the oven appliance 100 can place a variety of different items to be cooked in chamber 105. A broil or top heating elements 130 (FIG. 3) and a bake or bottom heating element 131 (FIG. 3) are positioned at or adjacent the top of chamber 105 and the bottom of chamber 105, respectively, and provide heat for cooking. Top and bottom heating elements 130 and 131 can be gas burners, electric resistance heating elements, microwave elements, or a combination thereof. Racks (not shown) in chamber 105 can be used to place food items at various levels for cooking. A window 110 on door 104 allows the user to view chamber 105 during the cooking process.

Oven appliance 100 includes a user interface 102 having a display 103 and a variety of controls 112. User interface is positioned on a top panel 114 of oven appliance 100. User interface 102 allows the user to select various options for the operation of oven appliance 100 including e.g., temperature, time, and/or various cooking and cleaning cycles.

Operation of oven appliance 100 can be regulated by a controller (not shown) that is operatively coupled or in communication with user interface panel 102, top and bottom heating elements 130 and 131 and other components of oven appliance 100. As an example, in response to user manipulation of the user interface panel 102, the controller can operate top and bottom heating elements 130 and 131. The controller can also receive measurements from a temperature sensor (not shown) within chamber 105 and provide a temperature indication to the user with display 103. Input/output ("I/O") signals are routed between the controller and various operational components of appliance 100, such as top and bottom heating elements 130 and 131, controls 112, display 103, sensor(s), alarms, and/or other components as may be provided. In one embodiment, the user interface panel 102 may represent a general purpose I/O ("GPIO") device or functional block.

As will be understood by those skilled in the art, oven appliance 100 is provided by way of example only. Thus, although shown as a single wall oven appliance in the exemplary embodiment of FIG. 1, the present subject matter can also be used with other oven appliances. For example, the present subject matter may be used with double wall oven appliances, oven range appliances, etc.

Figure 3:
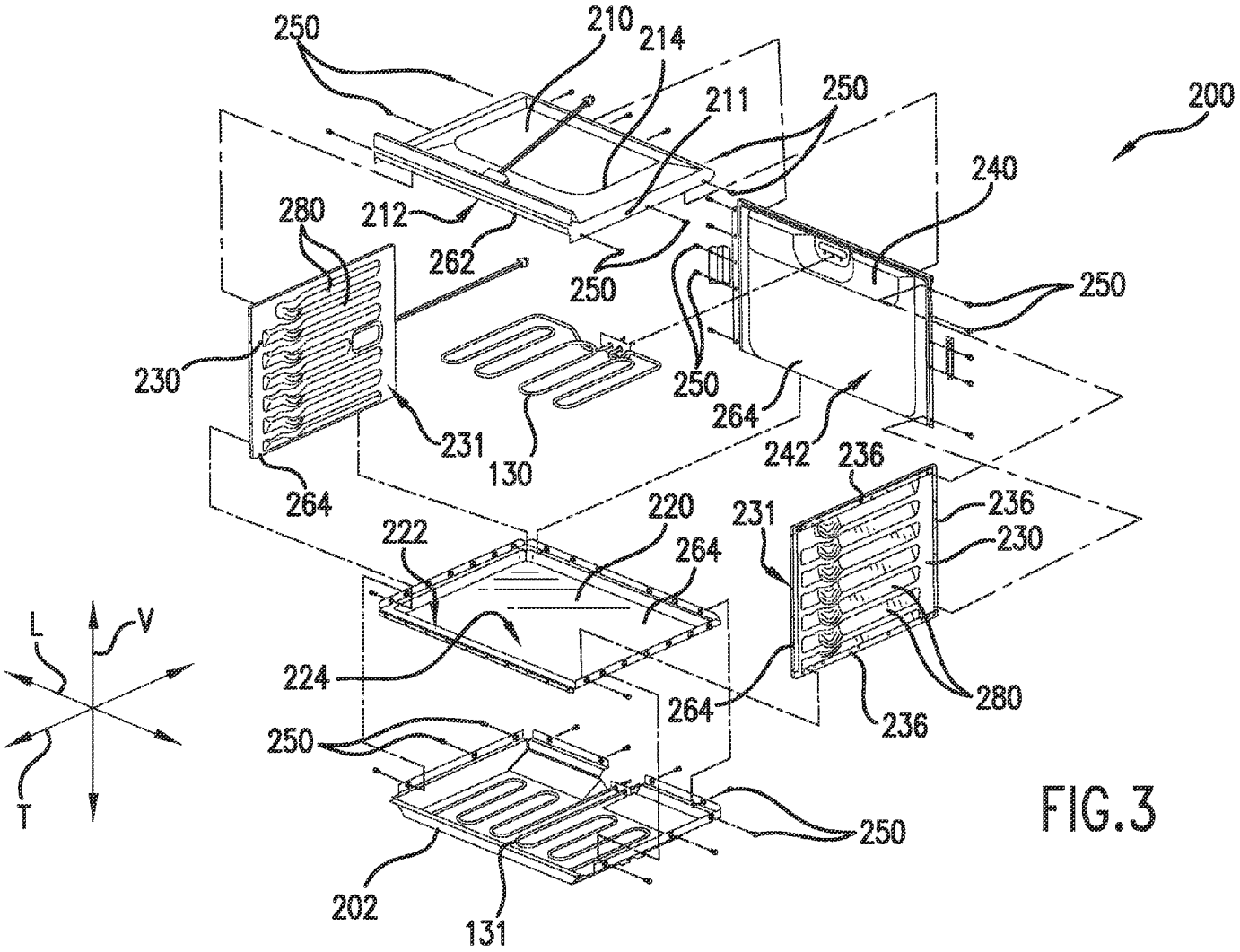
FIG. 3 provides an exploded view of the exemplary panel assembly of FIG. 2.

FIG. 2 provides a perspective view of a panel assembly 200 of oven appliance 100 (FIG. 1) according to an exemplary embodiment of the present subject matter. FIG. 3 provides an exploded view of panel assembly 200. As may be seen in FIGS. 2 and 3, panel assembly 200 defines a vertical direction V, a lateral direction L and a transverse direction T. The vertical direction V, the lateral direction L and the transverse direction T are mutually perpendicular and form an orthogonal direction system. Panel assembly 200 defines cooking chamber 105 of oven appliance 100. In particular, as discussed in greater detail below, panel assembly 200 includes a plurality of panels mounted or fastened to each other. Inner surfaces of the panels define cooking chamber 105.

As may be seen in FIGS. 2 and 3, panel assembly 200 includes a top panel 210 and bottom panel 220. Top panel 210 and bottom panel 220 are spaced apart from each other, e.g., along the vertical direction V. Panel assembly 200 also includes a pair of side panels 230. Side panels 230 are spaced apart from each other, e.g., along the lateral direction L. Side panels 230 extending between top panel 210 and bottom panel 220, e.g., along the vertical direction V. In particular, side panels 230 extend between a top portion 237 and a bottom portion 238, e.g., along the vertical direction V. Top portion 237 of side panels 230 is positioned on or proximate top panel 210. Conversely, bottom portion 238 of side panels 230 is positioned on or proximate bottom panel 220. In particular, bottom portion 238 of side panels 230 can rest or sit on an outer surface 222 of bottom panel 220. A plurality of rack supports 280 can also be embossed on or mounted to side panels 230. A back panel 240 of panel assembly 200 also extends between top panel 210 and bottom panel 220, e.g., along the vertical direction V. Back panel 240 also extends between side panels 230, e.g., along the lateral direction L.

Panel assembly 200 also includes a plurality of fasteners 250. Fasteners 250 assist with mounting top panel 210, bottom panel 220, side panels 230 and back panel 240 to one another. In particular, as discussed in greater detail below, each fastener of fasteners 250 extends through top panel 210 or bottom panel 220 and side panels 230 or back panel 240 in order to assemble or build panel assembly 200.

Turning to FIG. 3, top heating element 130 is positioned at top panel 210 and mounted to back panel 240. In particular, top panel 210 defines a tray 214. Top heating element 130 is disposed within tray 214 on an outer surface 212 of top panel 210. Bottom heating element 131 is positioned below bottom panel 220, e.g., along the vertical direction V. Bottom heating element 131 is mounted to and positioned within a pan 202 of panel assembly 200 below bottom panel 220.

Outer surface 212 of top panel 210, outer surface 222 of bottom panel 220, outer surfaces 231 of side panels 230 and outer surface 242 of back panel 240 define cooking chamber 105 (FIG. 2) of oven appliance 100 and are visible to a user of oven appliance 100, e.g., when door 104 is open. Various coatings are appliance to panels of panel assembly 200 to assist with operation of oven appliance 100 as discussed in greater detail below.

Top panel 210 includes an aluminum coating 262 disposed on outer surface 212 of top panel 210. Aluminum coating 262 can assist with reflecting heat from top heating element 130 into cooking chamber 105. Aluminum coating 262 can include any suitable aluminum coating. For example, aluminum coating 262 may include aluminum oxide.

Bottom panel 220, side panels 230 and back panel 240 include an enamel coating 264. In particular, enamel coating 264 is disposed on outer surface 222 of bottom panel 220, an outer surface 231 of each side panel 230 and an outer surface 242 of back panel 240. Enamel coating 264 can assist with cleaning of oven appliance 100. For example, debris and food particles disposed on enamel coating 264 can be easy to clean relative to such debris and food particles disposed on outer surface 222 of bottom panel 220 and similar surfaces of panel assembly 200.

Figure 4:
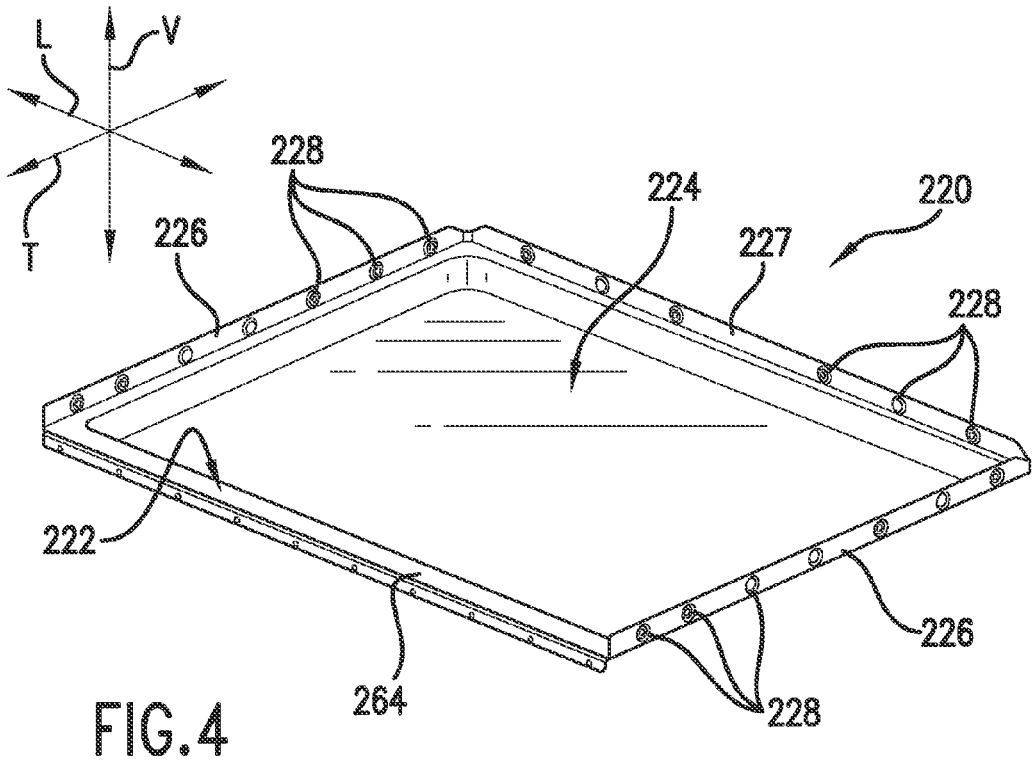
FIG. 4 provides a perspective view of a bottom panel of the exemplary panel assembly of FIG. 2.

FIG. 4 provides a perspective view of bottom panel 220 of panel assembly 200. As may be seen in FIG. 4, bottom panel 220 includes a pair of side flanges 226. Side flanges 226 of bottom panel 220 are spaced apart from each other, e.g., along the lateral direction L, such that side flanges 226 of bottom panel 220 are positioned on opposite sides of bottom panel 220, e.g., along the lateral direction L. Side flanges 26 extend upwardly, e.g., along the vertical direction V, away from outer surface 222 of bottom panel 220. Each side flange of side flanges 226 of bottom panel 220 also defines a plurality of projections or embossments 228. Embossments 228 extend along the lateral direction L and are spaced apart from one another alone the transverse direction T. Bottom panel 220 also includes a back flange 227 that extend upwardly, e.g., along the vertical direction V, away from outer surface 222 of bottom panel 220 and defines embossments 228.

Bottom panel 220 also defines a sump 224. Sump 224 is configured for receiving liquids during operation of oven appliance 100. For example, liquids from pans or baking dishes can flow out of such containers and collect in sump 224 of bottom panel 220. Thus, sump 224 can limit such liquids from flowing to other undesirable locations within oven appliance 100.

Figure 5:
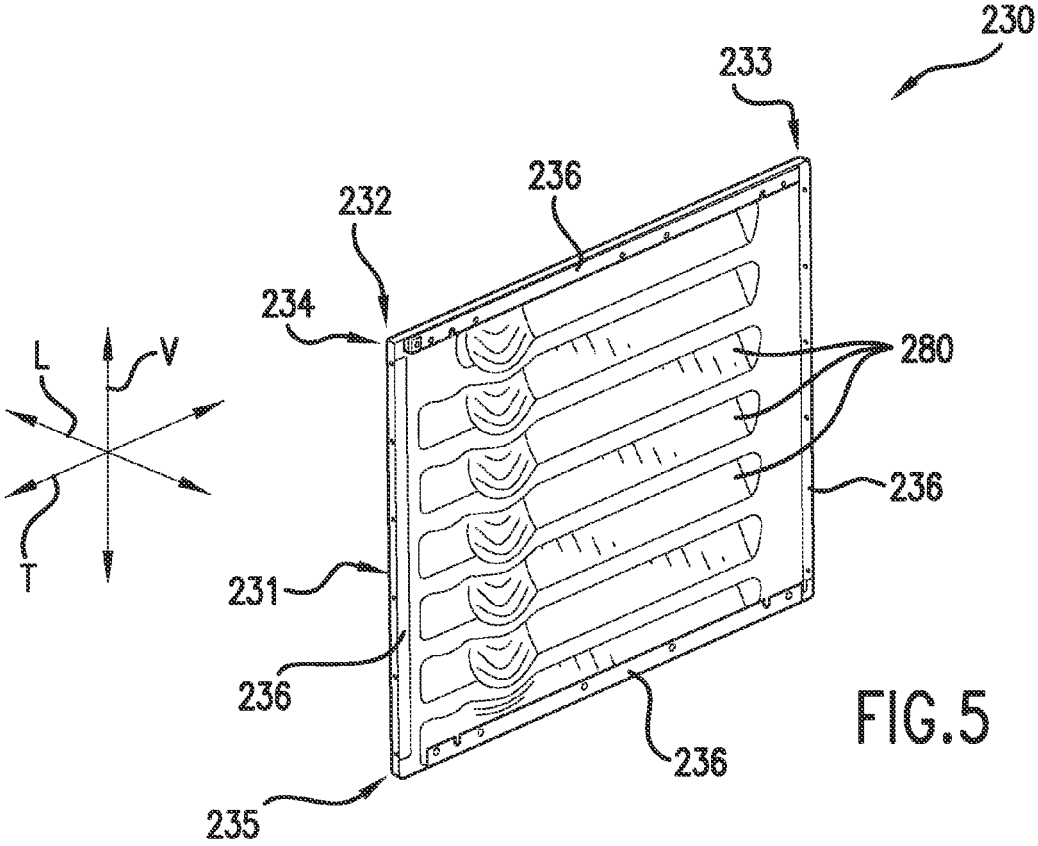
FIG. 5 provides a perspective view of a side panel of the exemplary panel assembly of FIG. 2.

FIG. 5 provides a perspective view of one of side panels 230. As may be seen in FIG. 5, side panels 230 each extend between a first side portion 232 and a second side portion 233, e.g., along the transverse direction T. Side panels 230 also each extend between a top portion 234 and a bottom portion 235, e.g., along the vertical direction V.

Side panels 230 also include a plurality of return flanges 236. Return flanges 236 are spaced apart from outer surface 231 of side panels 230, e.g., along the lateral direction L. A respective return flange 236 is positioned at first and second side portions 232 and 233 of side panels 230 and top and bottom portions 234 and 235 of side panels 230.

Back panel 240 (FIG. 3) includes similar return flanges spaced apart from outer surface 242 of back panel 240, e.g., along the transverse direction T. Thus, back panel 240 can be constructed in a similar manner to side panel 230 shown in FIG. 5.

Figure 6:
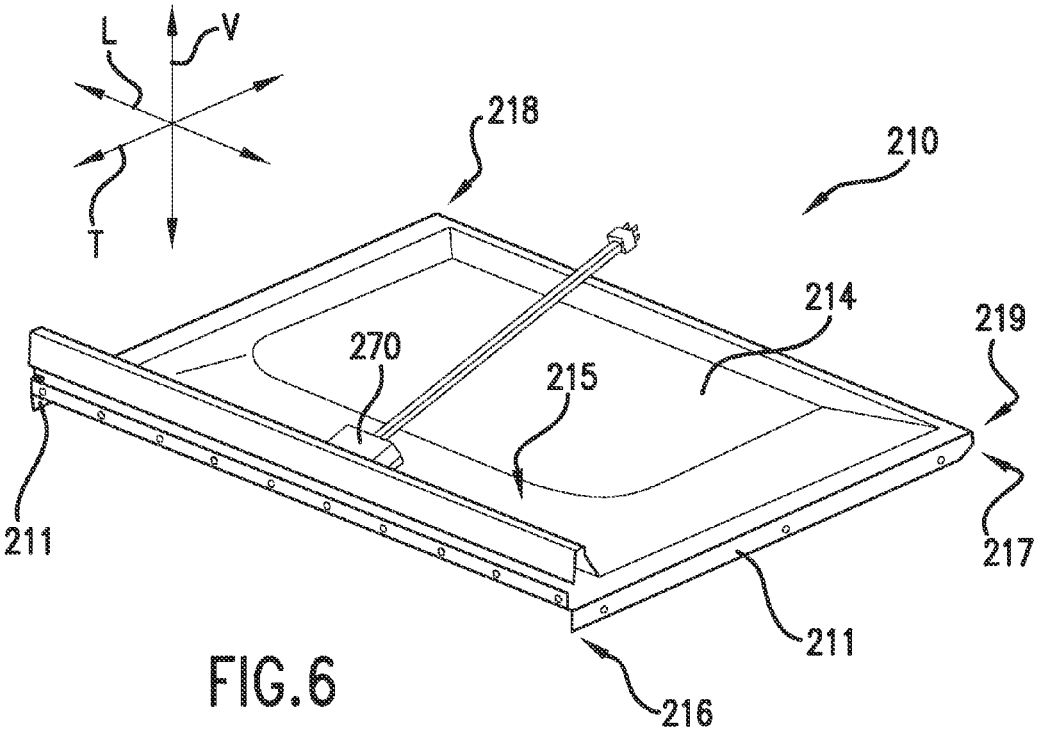
FIG. 6 provides a perspective view of a top panel of the exemplary panel assembly of FIG. 2.

FIG. 6 provides a perspective view of top panel 210 of panel assembly 200. As may be seen in FIG. 6, top panel 210 extends between a front portion 216 and a rear portion 217, e.g., along the transverse direction T. Top panel 210 also extends between a first side portion 218 and a second side portion 219, e.g., along the lateral direction L.

As discussed above, top panel 210 defines tray 214. Tray 214 includes an angled surface 215. Angled surface 215 is angled relative to the vertical and transverse direction V and T such that a line that is normal to angled surface 215 is not perpendicular to either the vertical direction V or the transverse direction T. Angled surface 215 is positioned proximate front portion 216 of top panel 210. A light assembly 270 is mounted to top panel 210 at angled surface 215 of tray 214. Light assembly 270 directs light into cooking chamber 105, e.g., when door 104 is open or a button or switch on user interface 102 is triggered. Light assembly 270 can include any suitable device for emitting light, such as an incandescent bulb, a light emitting diode, etc. By mounting light assembly 270 on angled surface 215, light assembly 270 can be hidden from a user of oven appliance 100 when the user looks into cooking chamber 105.

Like bottom panel 220 discussed above in relation to FIG. 4, top panel 210 includes a pair of side flanges 211. Side flanges 211 of top panel 210 are spaced apart from each other, e.g., along the lateral direction L, such that side flanges 211 of top panel 210 are positioned on opposite sides of top panel 210, e.g., along the lateral direction L, such as the first and second side portions 218 and 219 of top panel 210. Side flanges 211 of top panel 210 extend downwardly, e.g., along the vertical direction V, away from outer surface 212 of top panel 210. Top panel 210 can also include a back flange (not shown) like bottom panel 220.

Figure 7:
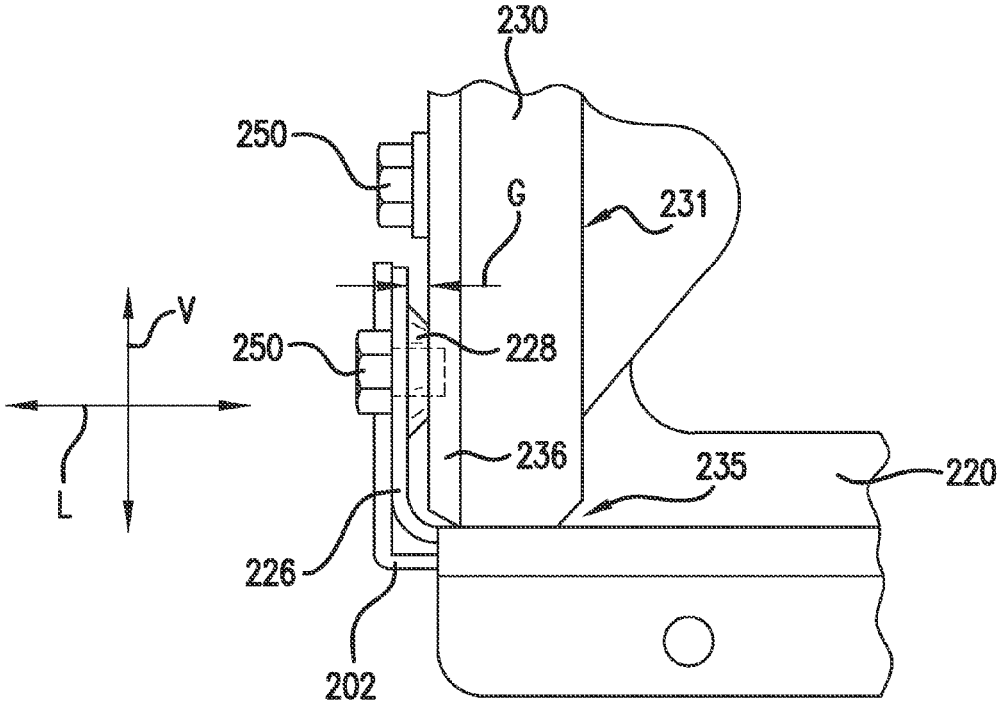
FIG. 7 provides a partial front, elevation view of the exemplary panel assembly of FIG. 2 with the side panel of the exemplary panel assembly mounted to the bottom panel of the exemplary panel assembly.
Figure 8:
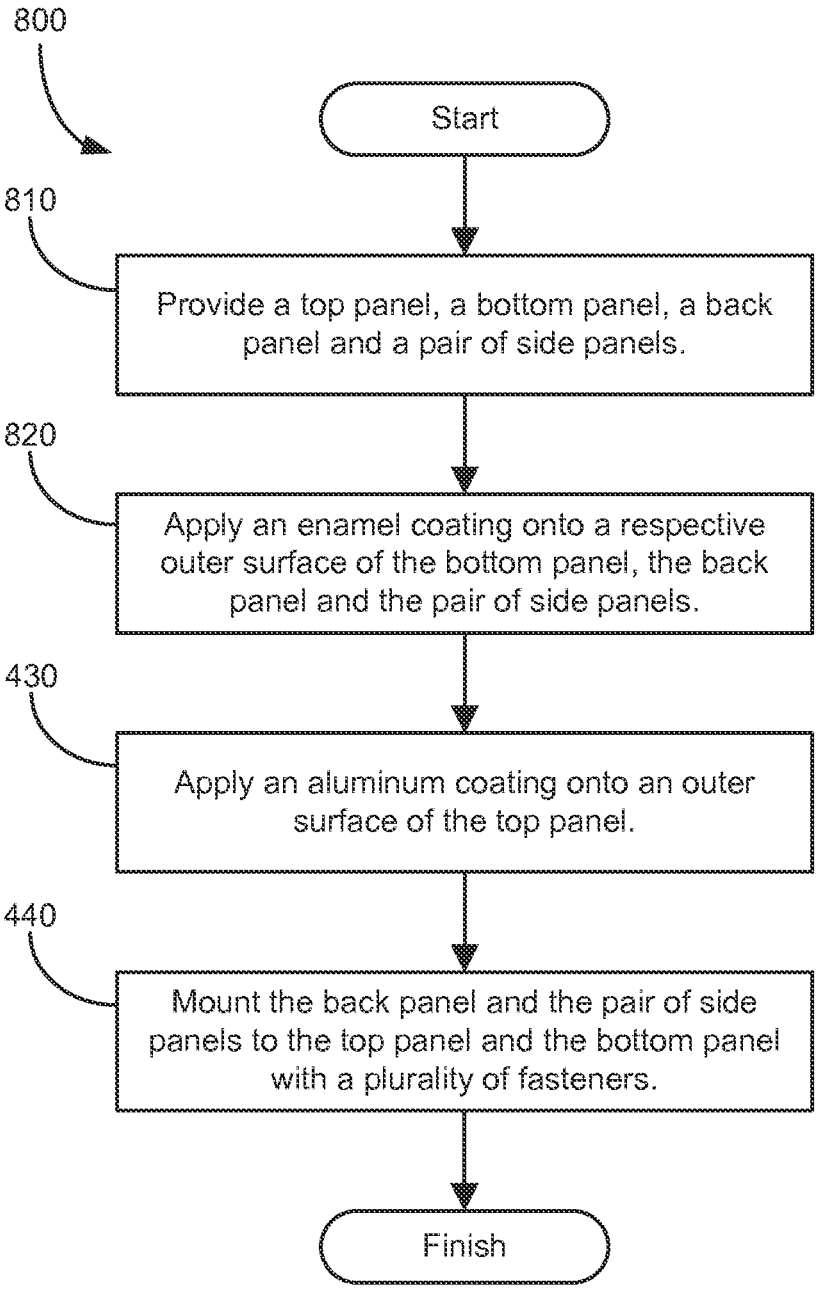
FIG. 8 illustrates a method for manufacturing a panel assembly of an oven appliance according to an exemplary embodiment of the present subject matter.

FIG. 7 provides a partial front, elevation view of panel assembly 200 with side panel 230 mounted to bottom panel 220 with fastener 250. As may be seen in FIG. 7, fastener 250 extends through side flange 226 of bottom panel 220 and return flange 236 of side panel 230 to secure or mount bottom panel 220 to side panel 230. In such a manner, bottom panel 220 and side panel 230 are mounted to each other, and fastener 250 does not extend through outer surface 231 of side panel 230, e.g., into cooking chamber 105. In such a manner, fastener 250 may not visible to a user of oven appliance 100 looking into cooking chamber 105.

Panel assembly 200 also includes features for assisting with limiting or hindering liquid weeping upwardly along the vertical direction V between side flange 226 of bottom panel 220 and return flange 236 of side panel 230. As may be seen in FIG. 7, side flange 226 of bottom panel 220 is spaced apart from return flange 236 of side panel 230, e.g., along the lateral direction L, such that side flange 226 of bottom panel 220 and return flange 236 of side panel 230 define a gap G therebetween. In particular, return flange 236 of side panel 230 is positioned on embossment 228 of bottom panel 220 such that side flange 226 of bottom panel 220 and return flange 236 of side panel 230 define the gap G therebetween. Fastener 250 extends through embossment 228 on side flange 226 of bottom panel 220 and return flange 236 of side panel 230. The gap G is sized, e.g., along the lateral direction L, such that liquid on side panel 230 and bottom panel 220 does not weep upwardly along the vertical direction V at the gap G. Back panel 240 (FIG. 3) is mounted to bottom panel 220 in a similar manner, e.g., to limit or hinder liquid weeping upwardly along the vertical direction V between bottom panel 220 and back panel 240.

Turning back to FIG. 3, top panel 210 is also mounted to side panels 230 and back panel 240 with fasteners 250. In particular, fasteners 250 extend through side flanges 211 of top panel 210 and return flanges 236 of side panels 230 to mount top panel 210 to side panel 230. Top panel 210 may be mounted to back panel 240 in a similar manner. Thus, as discussed above, fasteners 250 do not extend into cooking chamber 105 and are not visible to a user of oven appliance 100 from cooking chamber 105.

Method 800 illustrates a method 800 for manufacturing a panel assembly of an oven appliance. Method 800 can be used to manufacture any suitable oven appliance. For example, method 800 may be used to assemble panel assembly 200 (FIG. 2) of oven appliance 100 (FIG. 1) in order to form cooking chamber 105.

At step 810, top panel 210, bottom panel 220, back panel 240 and side panels 230 are provided. At step 820, enamel coating 264 is applied to outer surface 222 of bottom panel 220, outer surface 242 of back panel 240 and outer surfaces 231 of side panels 230. At step 830, aluminum coating 262 is applied to outer surface 212 of top panel 210. At step 840, back panel 240 and side panels 230 are mounted to top panel 210 and bottom panel 220 with fasteners 250. In particular, back panel 240 and side panels 230 are mounted to top panel 210 and bottom panel 220 with fasteners 250 after enamel coating 264 is applied to bottom panel 220, side panels 230 and back panel 240 at step 820 and aluminum coating 262 is applied to top panel 210 at step 830. In such a manner, enamel coating 264 and aluminum coating 262 are applied before assembling top panel 210, bottom panel 220, side panels 230 and back panel 240. Method 800 can assist permit enamel coating 264 and aluminum coating 262 to be applied more easily and can also assist with reducing or limiting damage to enamel coating 264 and aluminum coating 262 during assembly of panel assembly 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, the oven appliance defining a vertical direction, a lateral direction and a transverse direction, the vertical, lateral and transverse directions being mutually perpendicular, the oven appliance comprising:

a top panel having an aluminum coating disposed on an outer surface of the top panel;

a bottom panel spaced apart from the top panel along the vertical direction, the bottom panel includes a pair of side flanges extending upwardly along the vertical direction and spaced apart from each other along the lateral direction, the bottom panel also defining a sump positioned below the pair of side flanges along the vertical direction;

a pair of side panels spaced apart from each other along the lateral direction, the pair of side panels extending between the top and bottom panels along the vertical direction, each side panel of the pair of side panels defining an outer surface and having a return flange spaced apart from the outer surface along the lateral direction, each side flange of the pair of side flanges positioned adjacent a respective return flange of the pair of side panels such that each side flange of the pair of side flanges and the respective return flange of the pair of side panels define a gap along the lateral direction therebetween;

a back panel extending between the top and bottom panels along the vertical direction; and a plurality of fasteners, each fastener of the plurality of fasteners extending through the top panel or the bottom panel and a respective return flange of the pair of side panels in order to mount the pair of side panels to the top and bottom panels, wherein an enamel coating disposed on the outer surface of each side panel of the pair of side panels, an outer surface of the bottom panel and an outer surface of the back panel.

2. The oven appliance of claim 1, wherein the plurality of fasteners do not extend through the outer surface of each side panel of the pair of side panels.

3. The oven appliance of claim 1, wherein each side flange of the pair of side flanges defines a plurality of embossments, the plurality of embossments of each side flange of the pair of side flanges positioned on the respective return flange of the pair of side panels such that the plurality of embossments extend across the gap to the respective return flange.

4. The oven appliance of claim 3, wherein a respective fastener of the plurality of fasteners extends through each embossment of the plurality of embossments and the respective return flange of the pair of side panels in order to mount the pair of side panels to the bottom panel.

5. The oven appliance of claim 1, wherein the back panel defines an outer surface and has a return flange spaced apart from the outer surface of the back panel along the transverse direction.

6. The oven appliance of claim 5, further comprising an additional plurality of fasteners, each fastener of the plurality of additional fasteners extending through the top panel or the bottom panel and the return flange of the back panel in order to mount the back panel to the top and bottom panels.

7. The oven appliance of claim 1, wherein the top panel defines a tray, the tray having an angled surface positioned proximate a front portion of the top panel.

8. The oven appliance of claim 7, further comprising a light assembly mounted to the top panel at the angled surface of the tray.

9. The oven appliance of claim 1, further comprising a heating element positioned below the bottom panel along the vertical direction.

10. A method of manufacturing a cooking chamber of an oven appliance, comprising:

providing a top panel, a bottom panel, a back panel and a pair of side panels;

forming a plurality of embossments on an upwardly extending side flange of the bottom panel and on an upwardly extending rear flange of the bottom panel, the bottom panel defining a sump positioned below the side flange and the rear flange of the bottom panel;

applying an enamel coating onto a respective outer surface of the bottom panel, the back panel and the pair of side panels;

applying an aluminum coating onto an outer surface of the top panel; and mounting the back panel and the pair of side panels to the top panel and the bottom panel with a plurality of fasteners after said steps of applying the enamel coating and applying the aluminum coating, said step of mounting comprising extending fasteners of the plurality of fasteners through the plurality of embossments on the side flange of the bottom panel and a return flange of the pair of side panels and extending fasteners of the plurality of fasteners through the plurality of embossments on the rear flange of the bottom panel and a return flange of the back panel, the plurality of embossments of the side flange positioned on the return flange of the pair of side panels such that the side flange and the return flange define a gap therebetween.

11. The method of claim 10, further comprising embossing a plurality of rack supports on the pair of side panels prior to said step of applying the enamel coating.

* * * * *